US005443028A

United States Patent [19]

Keen

[11] Patent Number: 5,443,028

[45] Date of Patent: Aug. 22, 1995

[54] FISHING BOAT MOUNTABLE ON JET-SKI-TYPE WATERCRAFT AND COMBINATION THEREOF

[76] Inventor: Robert J. Keen, Rte. 3, Box 284, Decatur, Ala. 35603

[21] Appl. No.: 352,843

[22] Filed: Dec. 2, 1994

[51] Int. Cl.[6] ..... B63B 21/56

[52] U.S. Cl. ..... 114/248; 114/258; 114/363

[58] Field of Search ..... 440/11, 12, 38; 114/61, 114/123, 283, 284, 292, 270, 246, 248, 352, 258, 259, 363

[56] References Cited

U.S. PATENT DOCUMENTS

| | | | |
|---|---|---|---|
| 3,659,546 | 5/1972 | Miklos | 114/248 |
| 3,857,127 | 12/1974 | Hendrickson | 114/258 |
| 4,085,473 | 4/1978 | Franklin | 114/363 |
| 4,694,770 | 9/1987 | Kitner et al. | 114/123 |
| 4,742,795 | 5/1988 | DePrey et al. | 114/362 |
| 5,136,963 | 8/1992 | Zuzik | 114/363 |
| 5,184,564 | 2/1993 | Robbins et al. | 114/270 |
| 5,255,625 | 10/1993 | Hattori | 114/248 |

FOREIGN PATENT DOCUMENTS

| | | |
|---|---|---|
| 63-301195 | 12/1988 | Japan . |
| 2046689 | 11/1980 | United Kingdom . |

*Primary Examiner*—Stephen Avila
*Attorney, Agent, or Firm*—Richard C. Litman

[57] ABSTRACT

The present invention relates to an unpowered watercraft which is releasably fastenable to an engine-powered jet-ski-type watercraft, a combination of the unpowered and engine-powered watercraft. The invention includes an L-shaped, pivotally-mounted transom connected to a U-shaped hull defining a completely open area into which a jet-ski-type watercraft will snugly fit. The pivotally-mounted transom is movable between a raised position for placing a jet-ski-type watercraft within the open area of the U-shaped hull, and a lowered locking position wherein the transom securely retains the jet-ski-type watercraft within the open area. The seating area of the jet-ski-type watercraft is available for passenger seating when the jet-ski-type watercraft is fastened to the U-shaped hull.

15 Claims, 1 Drawing Sheet

FISHING BOAT MOUNTABLE ON JET-SKI-TYPE WATERCRAFT AND COMBINATION THEREOF

BACKGROUND OF THE INVENTION

1. Field of the Invention

The present invention relates to an unpowered boat hull which is releasably engageable with a powered jet-ski-type watercraft. More specifically, the invention is an unpowered fishing boat hull including a pivotable transom which is releasably fixable to a jet- 2. Description of the Prior Art A number of United States and foreign patent references describe watercraft in which a powered jet-ski-type unit is mated to an unpowered hull section or sections. For instance, U.S. Pat. No. 4,694,770, issued Sep. 22, 1987, to W. M. Kitner et al., describes a pair of stabilizing flotation structures which surround the perimeter of a jet-ski-type craft. The hulls described in this reference are designed for stabilization of the craft only, and do not provide any storage space, or extra deck space to store articles such as fishing gear.

Another U.S. Pat. No. 5,184,564, issued Feb. 9, 1993, to W. H. Robbins et al., describes a U-shaped pontoon which fits about the bow and side walls of a jet-ski-type watercraft. The watercraft is slidingly engaged with the U-shaped pontoon, and held in engagement therewith via a bow nut and bolt assembly, and a slidably lockable transom section. Here, the transom section must be completely removed from the pontoon section in order to slide the watercraft into engagement with the U-shaped pontoon. Once the watercraft is fitted with the pontoon, the transom section is then placed between the open ends of the U-shaped pontoon, and held in place by screws or Velcro. This arrangement is very cumbersome: It would be difficult to maneuver the transom section into place in rough water. Additionally, the means which fasten the transom in place could easily be lost in the water during assembly. This would render the transom section inoperable.

U.S. Pat. No. 5,255,625, issued Oct. 26, 1993, to T. Hattori, describes a watercraft in which a jet-ski-type powered unit is berthed inside a mating main hull section. Of particular note in this reference is that the main hull berth into which the powered unit fits includes a lower wall which is complementary in shape to the hull of the powered unit. This configuration results in two distinct disadvantages: First, different main hull sections must be manufactured to securely engage the hulls of the wide variety of jet-ski-type watercraft now commercially available. Second, openings must be provided within the lower wall of the berth to allow water to access the jet propulsion motor of the powered unit. This also requires that the berth of the main hull be carefully matched to the specific type of power unit used. If the water intake port of the powered unit and the openings in the lower wall of the berth do not register properly, either insufficient water flow will reach the intake port, or cavitation will occur at the inlet port. Both conditions will significantly lower the effective thrust of the powered unit, and could damage the motor of the powered unit. Furthermore, the Hattori berth is at least partially closed at the hull line, which may cause undue cavitation of the berthed jet-ski-type watercraft when the combination is underway. In direct contradistinction thereto, the present invention provides a completely open and unrestricted berthing opening for the berthed jet-ski-type watercraft, so that not only is undesirable cavitation eliminated, but also different sizes and even configurations of jet-ski-type watercraft may be berthed.

The foreign patent literature includes Great Britain Patent No. 2 046 689 A, issued Nov. 19, 1980. This reference describes a watercraft in which a housing holding engine can be fit into a well within the craft. The craft is fully buoyant with or without the engine housing being fit into the well. The well of the craft also holds a propeller assembly which operationally connects to the engine when the engine housing is placed into the well. This arrangement allows the craft and the engine housing to be manufactured and assembled separate from one another. Additionally, the craft may be piloted using a rudder, or the housing containing the engine may be circular to effect steering of the craft.

Japan Pat. No. 63-301195, issued Dec. 8, 1988, describes a watercraft similar in concept to the craft described in the British Patent, above. The Japanese reference describes a watercraft in which an in-board/outboard-type engine can be removed from a hull unit. As in the British patent, the engine unit itself, however, is not a self-propelled watercraft, i.e., the engine is only an engine per se, not a jet-ski-type watercraft. The drawings in this reference indicate that once the engine has been removed from the hull of the craft, the hull is sufficiently light in weight to be transported on top of a passenger motor vehicle. The engine unit is then stored in the trunk space of the motor vehicle.

For the foregoing reasons, there is a need for an unpowered watercraft which is mountable to a jet-ski-type powered craft, which can be attached to the powered craft simply and with few or no detachable parts which may become lost, and which provides ample storage space.

SUMMARY OF THE INVENTION

The present invention relates to an unpowered watercraft, i.e. a boat hull, adapted to fit snugly about the edges of an engine-powered watercraft of the jet-ski variety, and a combination of the unpowered watercraft and the engine-powered watercraft. As used here, a jet-ski-type watercraft denotes a compact, one or two person, self-powered craft, resembling a motorcycle in general design. Such craft conventionally include a saddle for one or two riders, and handle bars including a spring-loaded throttle mechanism for controlling the craft. The means of locomotion in such watercraft is usually an impeller-driven water jet drive powered by an internal combustion engine. This feature, however, is not critical to the operation of the present invention, which will function equally well with a propeller-driven craft.

A wide variety of jet-ski-type watercraft are currently commercially available. All have differing designs which include the above-described basic design features. For sake of ease and clarity, the terms jet-ski-type watercraft, and engine-powered watercraft will be used interchangeably throughout the specification.

The invention includes a roughly U-shaped hull which has a bow section and two arm sections. The hull defines a completely open and unrestricted area for snugly receiving an engine-powered watercraft therein.

A transom, which is pivotally mounted to the two arm sections of the hull, aids in retaining the engine-powered watercraft within the open area of the hull. The transom, which may be roughly L-shaped, is movable between a raised position and a releasably-locking lowered position. To mate the engine-powered watercraft and the hull, the transom is raised, and the engine-powered water craft is maneuvered into the open area. The transom is then lowered, and locked into place. When locked in the lowered position, the transom frictionally engages a stern portion of the engine-powered watercraft. Additionally, the bow portion of the engine-powered craft may be releasably fastened to the bow portion of the hull via a releasable fastener.

The hull is sufficiently large in size to provide ample space for passengers and gear such as fishing poles, a trolling motor, fighting chairs, etc. Further, the saddle of the engine-powered craft, as well as the top surface of the transom, remain unencumbered, and may be used as passenger seating areas.

In operation, the combination unpowered craft and engine-powered craft may be navigated in exactly the same fashion as the engine-powered craft. An operator sits in the saddle of the engine-powered craft and steers using the handle bars or other similar steering mechanism. Or, an operator can sit to one side of the engine-powered craft and operate the steering mechanism of the engine-powered craft from that position.

DETAILED DESCRIPTION OF THE PREFERRED EMBODIMENTS

Figure 1:
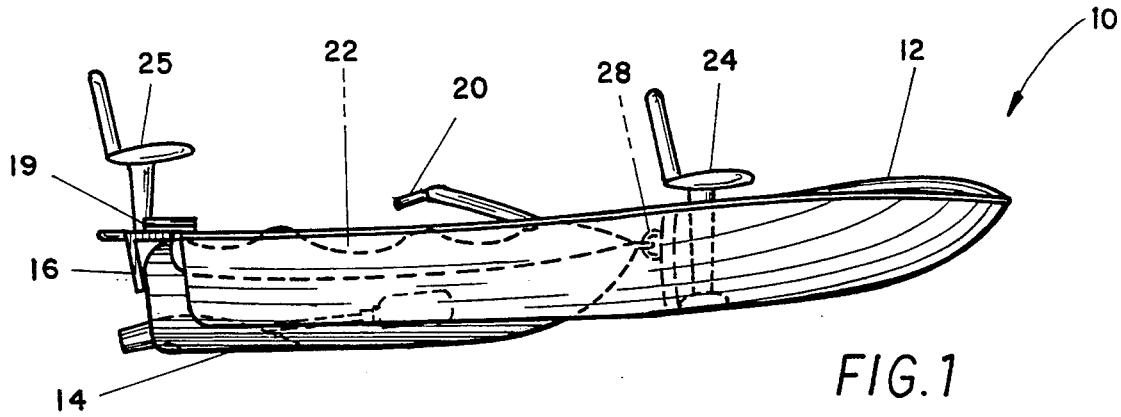
FIG. 1 is a right-side elevational view of the present invention mounted to a jet-ski-type watercraft.

Reference is made herein to the attached drawings. Identical reference numerals are used throughout the various drawings to identify identical elements of the claimed invention.

FIG. 1 is a right-side elevational view of the combined hull and engine-powered craft 10. The left-side is identical to the right. A U-shaped hull 12 is pivotally attached to transom 16, and may include fighting chairs 24 and 25. Releasable lock 19 releasably fastens a transom 16 in a lowered position.

Figure 2:
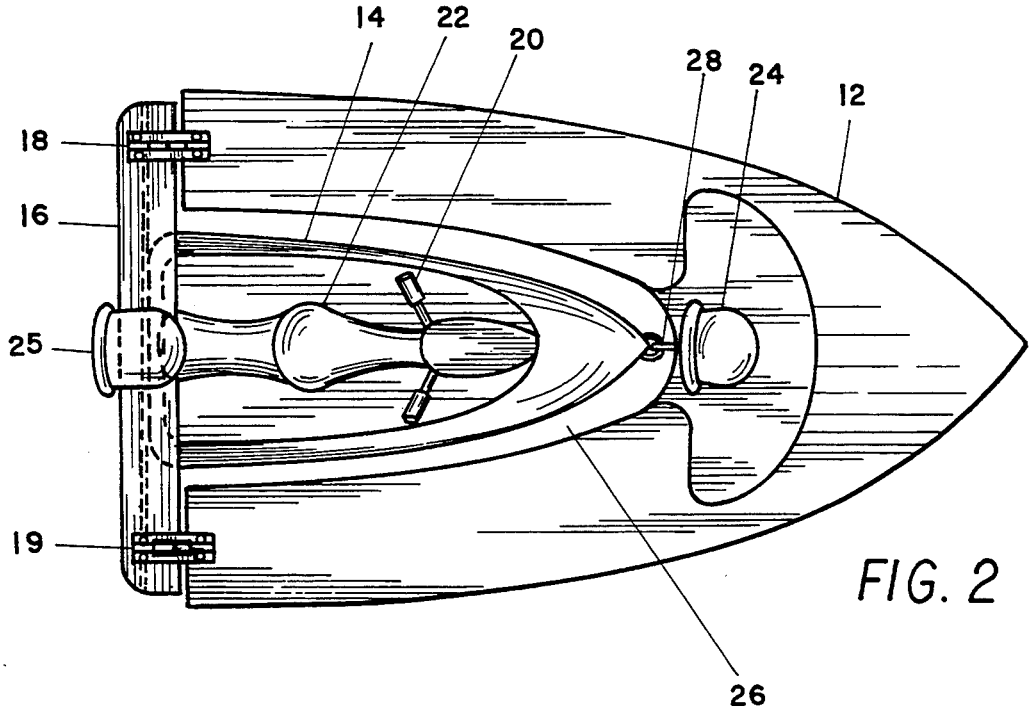
FIG. 2 is a top plan view of the present invention.

Releasably fastened within a completely open and unrestricted area (26 in FIG. 2) defined by the hull 12 is a jet-ski-type, self-powered watercraft 14. The watercraft 14 includes handlebar and throttle assembly 20 and saddle 22. Both the hull 12 and the jet-ski-type watercraft 14 have a bow portion and a stern portion, and port and starboard edges, as those terms are conventionally applied to watercraft. Releasable bow fastener 28 releasably maintains the jet-ski-type watercraft 14 within area FIG. 2 is a top plan view of the present invention, more clearly showing open area 26. The transom 16 is pivotally attached to the hull 12 via pivotable attachment means 18 and releasable lock 19. A fighting chair 25 may be mounted directly to the pivotable transom.

A releasable fastener 28 releasably connects the jet-ski-type watercraft 14 to the hull 12. The releasable fastener 28 may be any type of releasable fastener, including, but not limited to threadably-adjustable hook fasteners releasably connectable to an eyelet located on a bow portion of the engine-powered watercraft 14, nut and bolt-type threaded fasteners, adjustable hook and eye-type fasteners, spring-loaded jaw fasteners, and magnetic fasteners. A threadably adjustable hook fastener which connects to a bow eyelet of the jet-ski-type watercraft is preferred for its simplicity, ease of operation, and paucity of moving parts.

Figure 3:
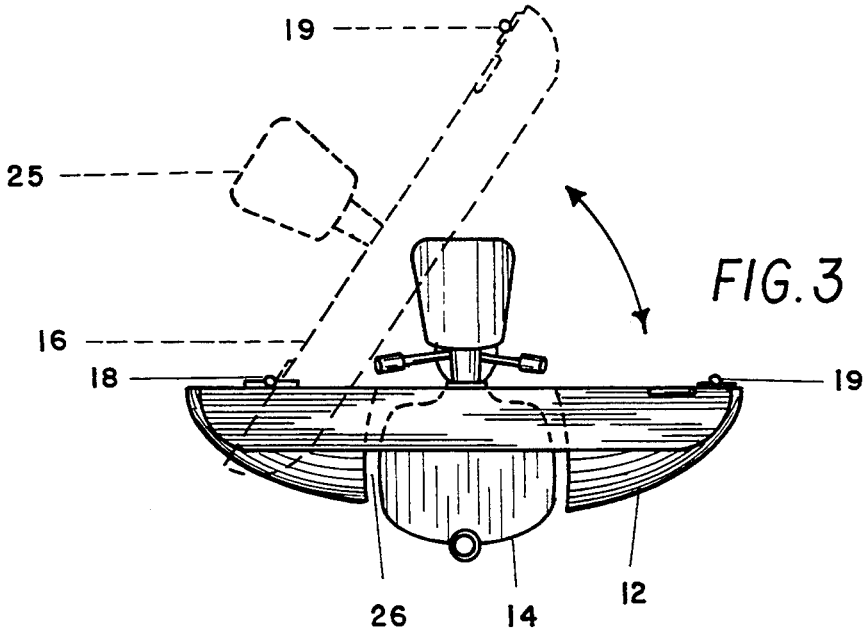
FIG. 3 is a rear elevation of the present invention, showing the transom in both the lowered and raised positions.

FIG. 3 is a rear elevational view showing further detail of the present invention. Transom 16, which is roughly L-shaped in cross-section, is shown in a raised position in dotted lines. The solid line representation shows the transom 16 in a lowered, locked position. Pivotable attachment means 18 may be doubly biased to maintain the transom 16 in either the raised or lowered position. Such pivotable attachment means include spring-loaded hinges, ratchet and pawl-type fasteners and the like.

FIG. 3 also shows that the transom 16 may have a far more shallow draft that the hull 12, leaving the hull of the jet-ski-type watercraft 14 extended below the configuration continuation of the hull 12.

As can be readily appreciated from an inspection of FIGS. 2 and 3, area 26 is completely open and unrestricted. Thus, to fit a jet-ski-type watercraft having either movable or fixed handlebars within area 26, one need only pivot transom 16 into the raised position, and the jet-ski-type watercraft is easily and neatly slid beneath the transom 16. The transom is then lowered and locked into position with releasable lock 19. The bow of the powered watercraft 14 may then be further secured using releasable fastener 28.

Also, and as can be appreciated from FIGS. 1 and 2, transom 16 when in the lowered position is frictionally engaged with the stern portion of the watercraft 14 for a snug interengagement of the watercraft 14 with the armed hull 12, and thus a secure fastening of the watercraft and hull together. As can further be appreciated from these two drawing figures, when the engine-powered watercraft is snugly received within the open area 26, the watercraft saddle 22 of the engine-powered watercraft is available as a passenger seating area.

It is to be understood that the present invention is not limited to the embodiments described above, but encompasses any and all embodiments within the scope of the following claims.

I claim

1. A watercraft comprising:

a U-shaped hull having a bow section and two arm sections, and defining a completely open and unrestricted area for snugly receiving an engine-powered watercraft therein;

said open area defined by a front wall having at least one releasable fastener releasably connectable to a bow portion of the engine-powered watercraft, and two side walls; and a transom pivotally mounted to said two arm sections of said U-shaped hull, said transom movable between a raised position and a releasably-locking lowered position, and when in said lowered position, said transom is frictionally engageable with a stern portion of the engine-powered watercraft.

2. The watercraft according to claim 1, wherein said transom is L-shaped.

3. The watercraft according to claim 2, further comprising a passenger seating area located on said L-shaped transom.

4. The watercraft according to claim 1, wherein said bow section and said two arm sections define seating and storage areas for accommodating a plurality of passengers and freight.

5. The watercraft according to claim 1, wherein said open area is dimensioned and configured such that when the engine-powered watercraft is snugly received within said open area, a seating area of the engine-powered watercraft is available as a passenger seating area.

6. The watercraft according to claim 1, wherein the engine-powered watercraft has a hull portion including a water intake manifold, and when the engine-powered watercraft is snugly received within said open area, the hull portion and the water intake manifold are fully exposed.

7. The watercraft according to claim 1, wherein said at least one releasable fastener is selected from the group consisting of nut and bolt-type threaded fasteners, adjustable hook and eye-type fasteners, spring-loaded jaw fasteners, and magnetic fasteners.

8. A watercraft comprising:

a U-shaped hull having a bow section and two arm sections, and defining a completely open and unrestricted area for snugly receiving an engine-powered watercraft therein;

said open area defined by a front wall having a releasable and threadably-adjustable hook fastener releasably connectable to an eyelet located on a bow portion of the engine-powered watercraft, and two side walls;

an L-shaped transom pivotally mounted to said two arm sections of said U-shaped hull, said transom movable between a raised position and a releasably-locking lowered position, and when in said lowered position, said transom is frictionally engageable with a stern portion of the engine-powered watercraft; wherein the engine-powered watercraft is securely fastened to said watercraft; and wherein when the engine-powered watercraft is snugly received within said open area, a seating area of the engine-powered watercraft is available as a passenger seating area.

9. A combination unpowered watercraft and engine-powered watercraft comprising:

an unpowered watercraft comprising a U-shaped hull having a bow section and two arm sections, and defining a completely open and unrestricted area for snugly receiving an engine-powered watercraft therein;

said open area defined by a front wall having at least one releasable fastener releasably connectable to a bow portion of said engine-powered watercraft, and two side walls;

a transom pivotally mounted to said two arm sections of said U-shaped hull, said transom movable between a raised position and a releasably-locking lowered position, and when in said lowered position, said transom is frictionally engageable with a stern portion of said engine-powered watercraft.

10. The combination according to claim 9, wherein said transom of said unpowered watercraft is L-shaped.

11. The combination according to claim 10, further comprising a passenger seating area located on said L-shaped transom.

12. The combination according to claim 9, wherein said bow section and said two arm sections define seating and storage areas for accommodating a plurality of passengers and freight.

13. The combination according to claim 9, wherein said open area is dimensioned and configured such that when said engine-powered watercraft is snugly received within said open area of said unpowered watercraft, a seating area of said engine-powered watercraft is available as a passenger seating area.

14. The combination according to claim 9, wherein said engine-powered watercraft has a hull portion including a water intake manifold, wherein when said engine-powered watercraft is snugly received within said open area of said unpowered watercraft, said hull portion and said water intake manifold of said engine-powered watercraft are fully exposed.

15. The combination according to claim 9, wherein said at least one releasable fastener is selected from the group consisting of nut and bolt-type threaded fasteners, adjustable hook and eye-type fasteners, spring-loaded jaw fasteners, and magnetic fasteners.

* * * * *